US008499698B2

(12) United States Patent
Youngs et al.

(10) Patent No.: US 8,499,698 B2
(45) Date of Patent: Aug. 6, 2013

(54) WORKSURFACE ASSEMBLY WITH PERSONAL CARRY ITEM STORAGE SHELF

(75) Inventors: Bradley D. Youngs, Byron Center, MI (US); Von Robinson, Grand Rapids, MI (US); Fredric James Biddle, Kalamazoo, MI (US); Steven James Beukema, Ada, MI (US); Mark William Spoelhof, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 13/423,871

(22) Filed: Mar. 19, 2012

(65) Prior Publication Data

US 2012/0266784 A1 Oct. 25, 2012

Related U.S. Application Data

(60) Provisional application No. 61/478,282, filed on Apr. 22, 2011.

(51) Int. Cl.
*A47B 85/00* (2006.01)

(52) U.S. Cl.
USPC ..... 108/25; 108/50.01

(58) Field of Classification Search
USPC .... 108/50.01, 50.02, 25, 26, 24, 27; 312/239, 312/240.2, 223.3, 270.1, 270.3
See application file for complete search history.

(56) References Cited

U.S. PATENT DOCUMENTS

| | | | | | |
|---|---|---|---|---|---|
| 21,832 | A | * | 10/1858 | Haskell | 108/26 |
| 776,355 | A | * | 11/1904 | Selander | 108/25 |
| 2,846,695 | A | * | 8/1958 | Hartog | 108/25 |
| 3,169,495 | A | * | 2/1965 | O'Brien | 108/26 |
| 3,290,108 | A | | 12/1966 | Beckman et al. | |
| 3,312,983 | A | * | 4/1967 | Jansson et al. | 108/25 |
| 3,364,882 | A | | 1/1968 | Merrick | |
| 4,094,255 | A | | 6/1978 | Zaccaria | |
| 4,145,097 | A | | 3/1979 | Naess et al. | |
| 4,312,507 | A | | 1/1982 | Smith et al. | |
| 4,345,803 | A | | 8/1982 | Heck | |
| D269,657 | S | | 7/1983 | Taylor | |
| 5,490,466 | A | * | 2/1996 | Diffrient | 108/50.01 |
| D371,468 | S | | 7/1996 | Sittel et al. | |
| 5,568,773 | A | | 10/1996 | Hung | |
| D386,921 | S | | 12/1997 | Wikman | |
| D387,583 | S | | 12/1997 | Shear | |
| 5,697,686 | A | | 12/1997 | Miller et al. | |
| 5,740,743 | A | * | 4/1998 | Schairbaum | 108/25 |
| 5,769,514 | A | | 6/1998 | Brown et al. | |
| 6,012,788 | A | | 1/2000 | Marschand et al. | |

(Continued)

*Primary Examiner* — Jose V Chen
(74) *Attorney, Agent, or Firm* — Price Heneveld LLP

(57) ABSTRACT

A worksurface assembly includes a worksurface member having an upper surface, a bottom surface, a forward edge, a rearward edge, and an aperture that opens both upwardly and forwardly from the worksurface member, and a storage member including a pair of sidewalls, a rear wall and a bottom wall that cooperate to form an interior storage area having a height to width ratio of greater than or equal to about 1:1 at at least one position along a length of the storage member, wherein the storage member has a forwardly facing opening and an upwardly facing opening, and wherein the storage member is readily detachably secured to the worksurface member such that the interior storage of the storage member is accessible through the aperture of the worksurface member and such that access to the interior space is uninterrupted between the forwardly facing opening and the upwardly facing opening of the storage member.

20 Claims, 5 Drawing Sheets

U.S. PATENT DOCUMENTS

| | | | | |
|---|---|---|---|---|
| 6,076,473 | A * | 6/2000 | Conte | 108/50.01 |
| 6,152,047 | A | 11/2000 | Mac Namara | |
| D450,959 | S | 11/2001 | Birsel et al. | |
| 6,394,006 | B2 | 5/2002 | Hoekstra et al. | |
| D467,698 | S | 12/2002 | Holbrook | |
| 6,662,732 | B2 | 12/2003 | Birsel et al. | |
| 6,722,673 | B1 | 4/2004 | Hamlin | |
| D505,581 | S | 5/2005 | Glass et al. | |
| 6,957,876 | B1 * | 10/2005 | DeMars | 108/26 |
| D511,535 | S | 11/2005 | Grobleben | |
| 7,029,079 | B2 * | 4/2006 | Holt | 312/223.3 |
| 2002/0129746 | A1 * | 9/2002 | Donnelly | 108/25 |
| 2003/0110989 | A1 * | 6/2003 | Chuang | 108/50.01 |
| 2007/0056482 | A1 * | 3/2007 | Robinson et al. | 108/25 |

* cited by examiner

WORKSURFACE ASSEMBLY WITH PERSONAL CARRY ITEM STORAGE SHELF

CROSS REFERENCE TO RELATED APPLICATION

This application claims the benefit of U.S. Provisional Patent Application No. 61/478,282, filed on Apr. 22, 2011, entitled "WORKSURFACE ASSEMBLY WITH PERSONAL CARRY ITEM STORAGE SHELF", the entire disclosure of which is incorporated herein by reference.

BACKGROUND OF THE INVENTION

The present invention relates to a worksurface assembly, and in particular to a worksurface assembly associated with desking units and office systems typically employed in office settings.

BRIEF SUMMARY OF THE INVENTION

One aspect of the present invention is to provide a worksurface assembly that comprises a worksurface member having an upper surface, a bottom surface, a forward edge and a rearward edge, wherein the worksurface member includes an aperture extending between the upper surface and the bottom surface, and wherein the aperture is located adjacent the forward edge of the worksurface member such that the aperture opens both upwardly and forwardly from the worksurface member, and a storage member including a pair of sidewalls, a rear wall and a bottom wall the cooperate to form an interior storage area having a height to width ratio of greater than or equal to about 1:1 at at least one position along a length of the storage member, wherein the storage member has a forwardly facing opening and an upwardly facing opening, and wherein the storage member is readily detachably secured to the worksurface member such that the interior storage area of the storage member is accessible through the aperture of the worksurface member and such that the access to the interior space is uninterrupted between the forwardly facing opening and the upwardly facing opening of the storage member.

Another aspect of the present invention is a worksurface assembly comprising a worksurface member having an upper surface, a bottom surface, a forward edge and a rearward edge, wherein the worksurface member includes an aperture extending between the upper surface and the bottom surface, and wherein the aperture is located adjacent the forward edge of the worksurface member such that the aperture opens both upwardly and forwardly from the worksurface member, and a storage member including a pair of sidewalls, a rear wall and a bottom wall that cooperate to form an interior storage area, the storage member including a forwardly facing opening and an upwardly facing opening, such that the interior storage area of the storage member is accessible through the aperture of the worksurface member and such that access to the interior space is uninterrupted between the forwardly facing opening and the upwardly facing opening of the storage member, the storage member including an upper flange extending outwardly from at least a select one of the side walls and the rear wall and abutting the upper surface of the worksurface member, such that the worksurface member is sandwiched between the support member and the flange.

The present inventive worksurface assembly includes an uncomplicated design that may be easily and quickly assembled with basic tools by even relatively unskilled personnel. The present inventive worksurface assembly is further efficient in its use of storing personal carry items such as backpacks, briefcases, laptop storage items, tote bags, and the like, and is particularly well adapted for the proposed use.

These and other features, advantages, and objects of the present invention will be further understood and appreciated by those skilled in the art by reference to the following specification, claims, and appended drawings.

DETAILED DESCRIPTION

Figure 1:
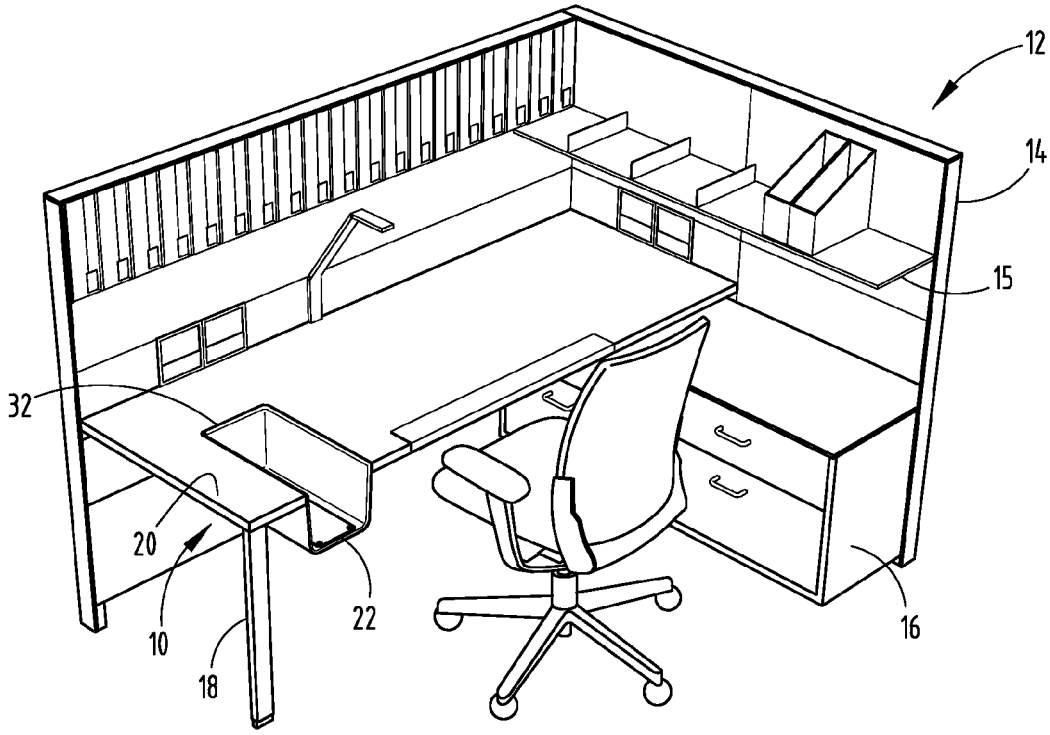
FIG. 1 is a perspective view of an office system that includes a worksurface assembly embodying the present invention.
Figure 3:
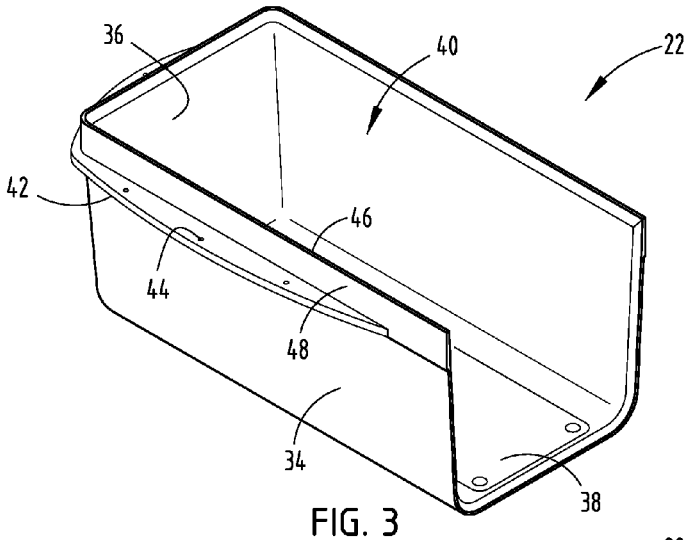
FIG. 3 is a perspective view of a storage member or shelf of the worksurface assembly.
Figure 4:
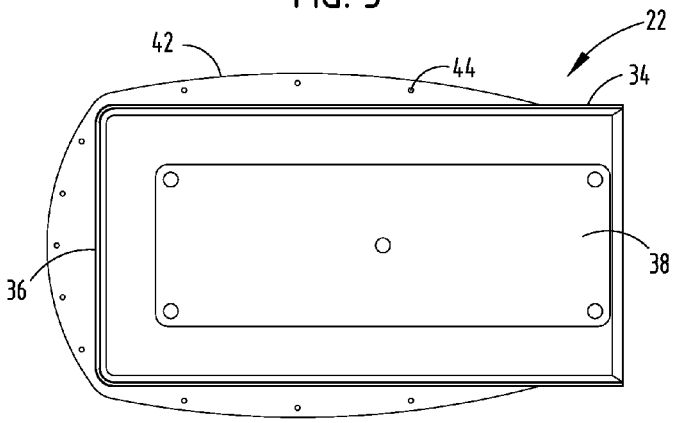
FIG. 4 is a bottom plan view of the storage member.
Figure 5:
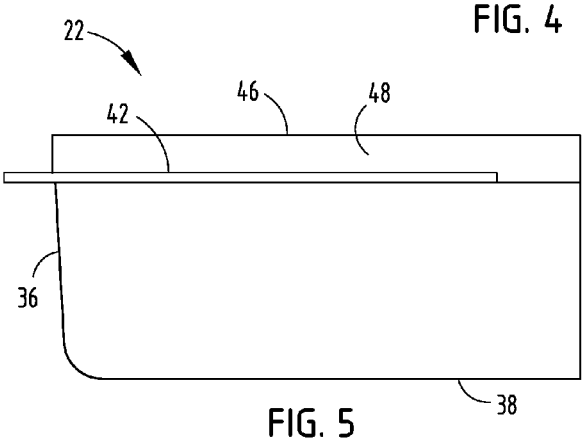
FIG. 5 is a side view of the storage member.
Figure 6:
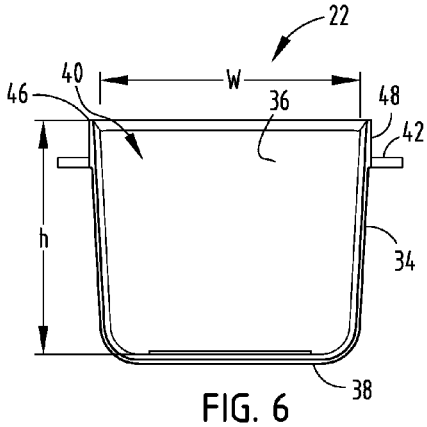
FIG. 6 is a front elevational view of the storage member.

For purposes of description herein, the terms "upper," "lower," "right," "left," "rear," "front," "vertical," "horizontal," and derivatives thereof shall relate to the invention as oriented in FIGS. 1 and 3. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other characteristics relating to the embodiments disclosed herein are not to be considered as limiting, unless the claims expressly state otherwise.

Figure 2:
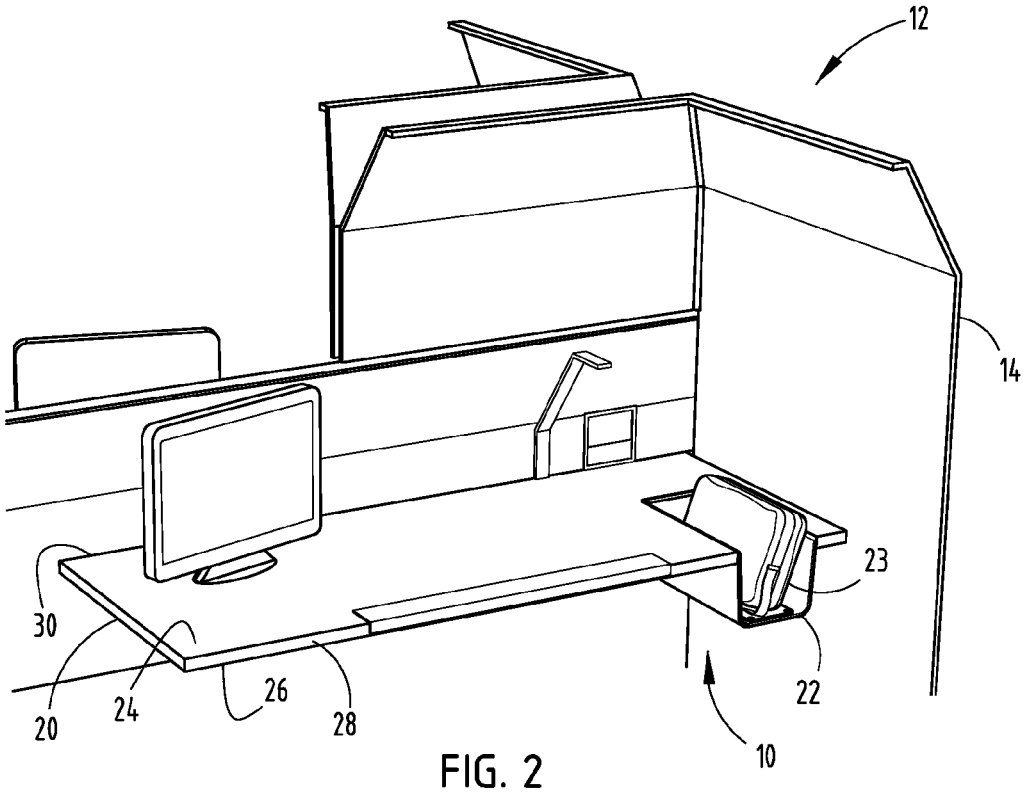
FIG. 2 is an enlarged partial perspective view of the office system including the present inventive worksurface assembly.

The reference numeral 10 (FIG. 1) generally designates a worksurface assembly 10 embodying the present invention, and utilized within an overall office system 12. In the illustrated example, the office system 12 is utilized to sub divide an overall office floor plan and provide an individual or small group work area, and comprises a plurality of panel assemblies 14, shelving assemblies 15 supported from the panel assemblies 14, storage assemblies 16, and the worksurface assembly 10. As illustrated, the worksurface assembly 10 is partially supported by the panel assemblies 14, the storage assemblies 16, and a leg assembly 18. The worksurface assembly 10 includes a planar worksurface member 20 and a storage member 22 attached thereto. As best illustrated in FIG. 2, the storage member 22 is configured and positioned so as to allow easy temporary storage of personal carry items 23 therein, such as book bags, briefcases, laptop storage bags, tote bags, purses, and the like, while simultaneously allowing easy access thereto and to retrieve and access items therefrom.

The worksurface member 20 includes an upper surface 24, a bottom surface 26, a forward edge 28 facing outwardly towards a work area, and a rearward edge 30. The worksurface member 20 also includes a rectangularly-shaped aperture 32 located adjacent the forward edge 28 such that the aperture 32 opens both upwardly and forwardly from the worksurface member 20. In the illustrated example, the aperture 32 does not extend through the entire depth of the worksurface member 20 and is spaced from the rearward edge 30.

As best illustrated in FIGS. 3-6, the storage member 22 includes a pair of sidewalls 34, a rear wall 36, and a bottom wall 38 that cooperate with one another to form a rectangular prism-shaped interior storage area 40. The interior storage area 40 includes a height h and a width w along the length thereof. The storage member 22 further includes a flange portion 42 extending substantially perpendicularly from the sidewalls 34 and rear wall 36. In the illustrated example, the flange portion 42 is integrally formed with the sidewalls 34 and rear wall 36. The flange portion includes a plurality of spaced apertures 44 adapted to receive mounting hardware therein so as to secure the storage member 22 to the worksurface member 20, as described below. The flange portion 42 is located at a distance spaced from the uppermost edge 46 of the storage member 22 so as to define a collar member 48 located between the flange portion 42 and the uppermost edge 46 and extending about the periphery of the storage member 22. In the illustrated example, the storage member 22 is formed as a single, integral unit and is comprised of a lightweight metal, such as aluminum, plastic, or other material suitable for the intended purpose.

Figure 7:
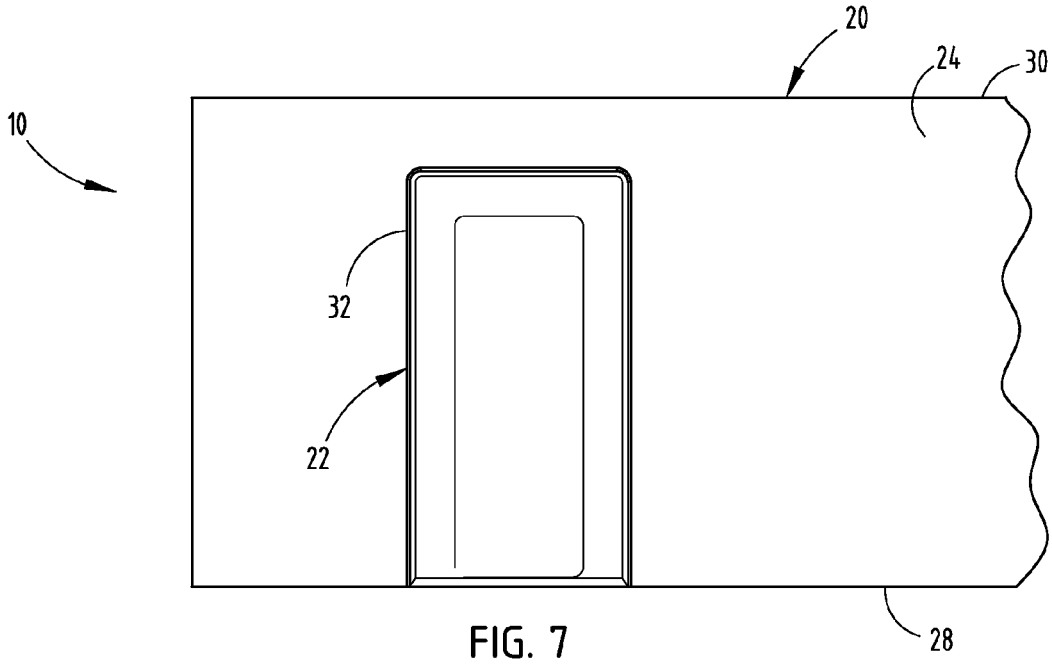
FIG. 7 is a top plan view of the storage member secured to a worksurface member of the worksurface assembly.
Figure 8:
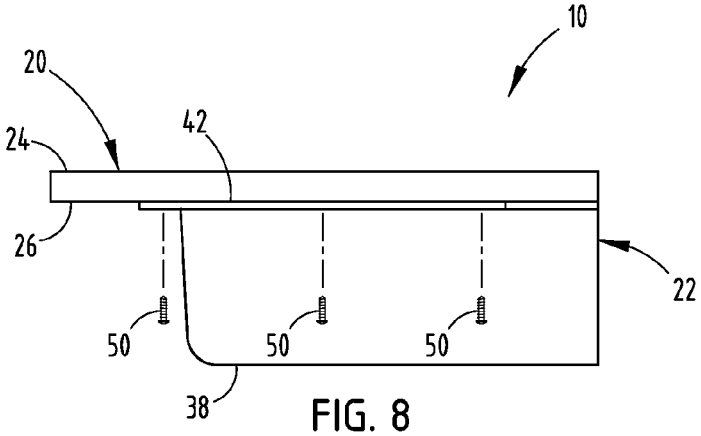
FIG. 8 is a side elevational view of the storage member secured to the worksurface member.
Figure 9:
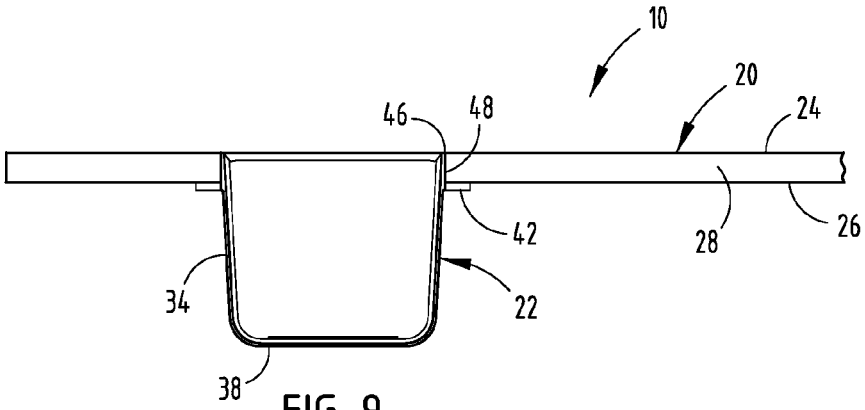
FIG. 9 is a front elevational view of the storage member secured to the worksurface member.
Figure 10A:
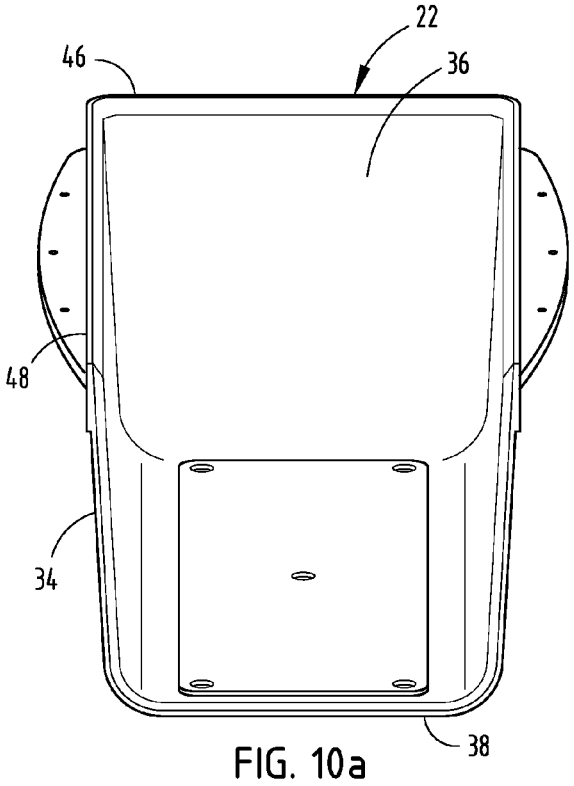
FIG. 10*a* is a perspective view of the storage member.
Figure 10B:
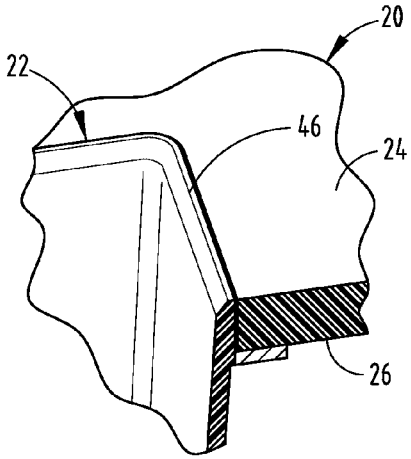
FIG. 10*b* is a partial perspective view of the storage member secured to the worksurface member.
Figure 10C:
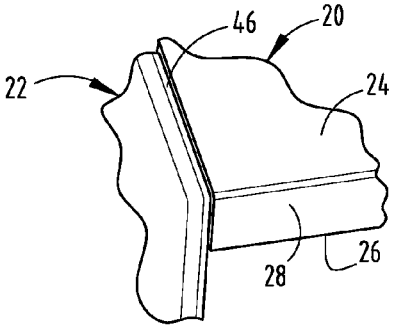
FIG. 10*c* is an enlarged perspective view of the storage member secured to the worksurface member.

In assembly, the storage member 22 (FIGS. 7-9) is positioned within the aperture 32 of the worksurface member 20 such that the collar member 48 extends upward into the aperture 32 and the uppermost edge 46 (FIGS. 10*a*-10*c*) of the storage member 22 is substantially coplanar with the upper surface 24 of the worksurface member 20. The storage member 22 is readily releasably secured to the worksurface member 20 by a plurality of mechanical fasteners, such as screws or bolts 50 that extend through corresponding apertures 44 and hold the flange portion 42 in abutment with the bottom surface 26 of the worksurface member 20.

Figure 11:
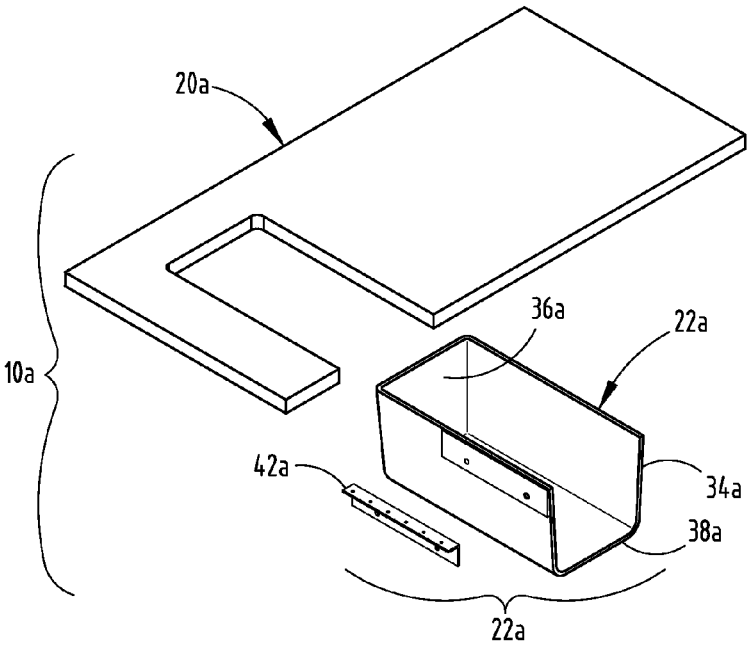
FIG. 11 is an exploded view of an alternative embodiment of the worksurface assembly.

The reference numeral 10*a* (FIG. 11) generally designates another embodiment of the present invention, having a worksurface member 20*a* and a storage member 22*a*. Since worksurface assembly 10*a* is similar to the previously described worksurface assembly 10, similar parts appearing in FIGS. 1-10*c* and FIG. 11 respectfully are represented by the same, corresponding reference numeral, except for the suffix "a" in the numerals of the latter. The worksurface assembly 10*a* is similar to the worksurface assembly 10 with the most notable exception being that the flange portion 42*a* of the storage member 22*a* is provided as a separate piece from the side walls 34*a* and rear wall 36*a*. Specifically, the flange portion 42*a* is formed as a piece of angle which is then secured to a corresponding sidewall 34*a* via a plurality of mechanical fasteners (not shown).

Figure 12:
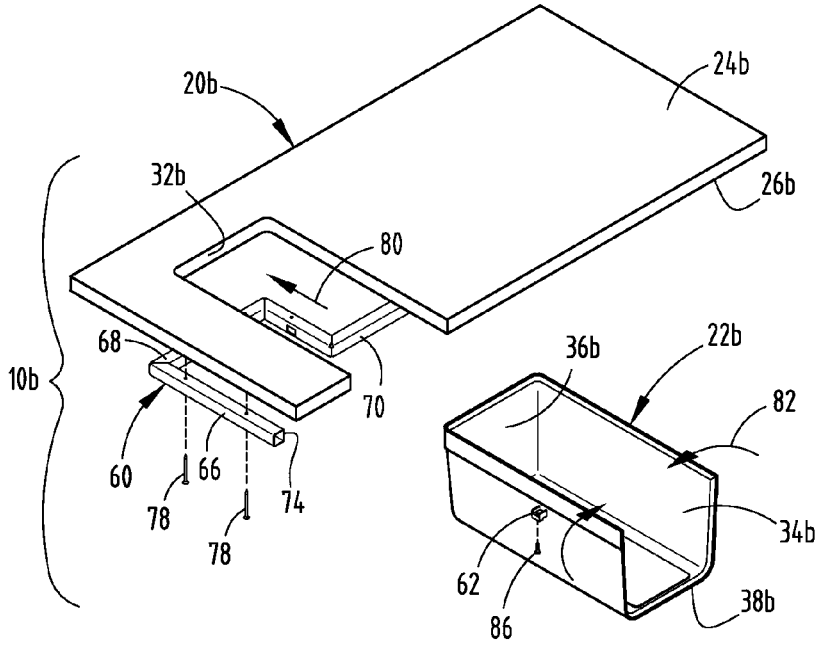
FIG. 12 is an exploded perspective view of a second alternative embodiment of the worksurface assembly.
Figure 13:
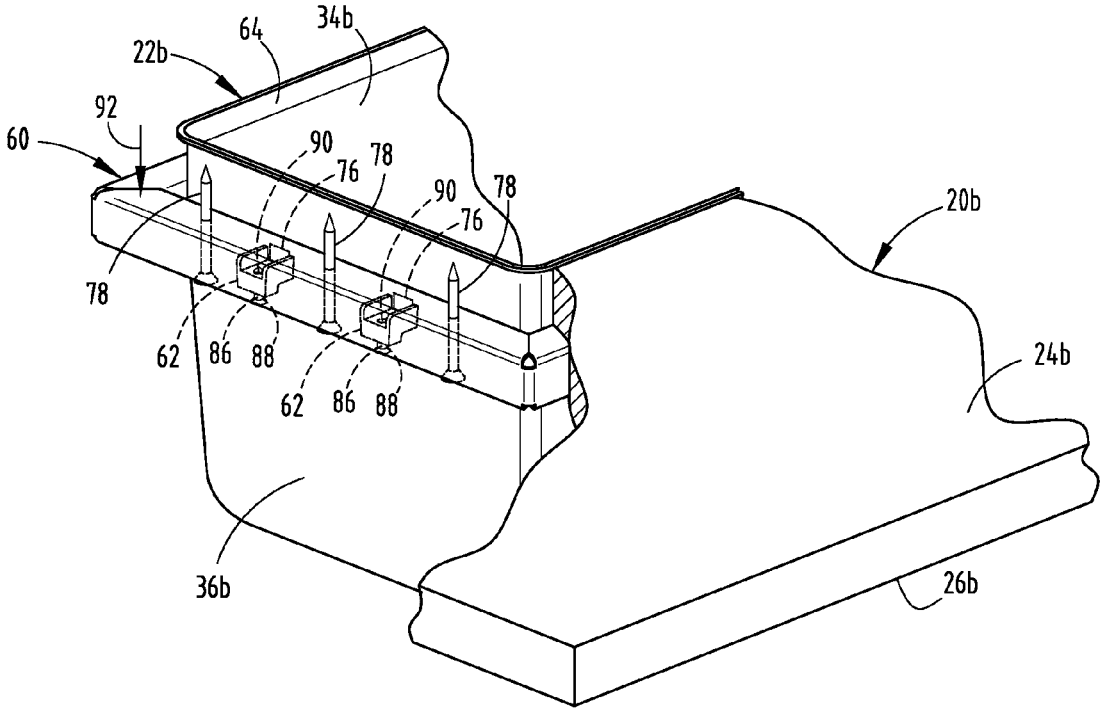
FIG. 13 is an enlarged perspective view of a portion of a worksurface and a storage member of the second alternative embodiment.

The reference numeral 10*b* (FIG. 12) generally designates another embodiment of the present invention, having a worksurface member 20*b* and a storage member 22*b*. Since the surface assembly 10*b* is similar to the previously described worksurface assembly 10, similar parts appearing in FIGS. 1-10*c* and FIG. 12, respectively are represented by the same, corresponding reference numeral, except for the suffix "b" in the numerals of the latter. In the illustrated example, the storage member 22*b* is supported from the worksurface member 20*b* by a tube member 60. Specifically, the storage member 22*b* includes a plurality of hook-shaped lugs 62 (FIGS. 12 and 13) spaced about the periphery thereof and extending outwardly from the side walls 34*b* and the rear wall 36*b*. A peripheral flange 64 also extends outwardly from the side walls 34*b* and the rear wail 36*b*. The tube member 60 includes a pair of laterally extending side portions 66, a longitudinally extending rear portion 68 integrally formed with and coupling the side portions 66, and a longitudinally extending leg portion 70. The side portions 66 of the tube member 60 are spaced so as to closely receive the storage member 22*b* therein. The tube member 60 further includes a plurality of apertures 76 spaced about the surfaces facing the space 74 and adapted to receive the corresponding lugs 62 therein, as described below.

In assembly, the tube member 60 is secured to the bottom surface 64*b* of the worksurface member 20*b* by a plurality of mechanical fasteners, such as screws 78. The storage member 22*b* is then inserted into the space 74 in a direction 80 until the lugs 62 extending from the rear wall 36*b* of the storage member 22*b* are received within the corresponding apertures 76 of the tube member 60. The lugs 62 extending outwardly from the side walls 34*b* of the storage member 22*b* are provided clearance into the space 74 by flexing the forward portions of the side walls 34*b* inwardly in a direction 82. Once the storage member 22*b* is properly positioned within the space 74 of the tube member 60, the side walls 34*b* of the storage member 22*b* are allowed to return to their original position, such that the lugs 62 are received within the corresponding apertures 76 located within the side members 66 of the tube member 60. The storage member 22*b* is then secured to the worksurface 20*b* and the tube member 60 by a plurality of mechanical fasteners 86 that are received within corresponding apertures 88 located within the tube member 60 and that are threadably received into apertures 90 located within each of the corresponding lugs 62. The force exerted by the screws 86 onto the storage member 22*b* draws the storage member 22*b* downwardly in a direction 92 until the worksurface member 20*b* is tightly sandwiched between the tube member 60 and the upper flange 64 of the storage member 22*b*.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A worksurface assembly, comprising:

a worksurface member having an upper surface, a bottom surface, a forward edge and a rearward edge, wherein the worksurface member includes an aperture extending between the upper surface and the bottom surface, and wherein the aperture is located adjacent the forward edge of the worksurface member such that the aperture opens through the upper surface and through the forward edge of the worksurface member; and a storage member including a pair of side walls, a rear wall and a bottom wall that cooperate to form an interior storage area having a height to width ratio of greater than or equal to about 1:1 at at least one position along a length of the storage member, wherein the storage member has a forwardly facing opening and an upwardly facing opening, and wherein the storage member is readily detachably secured to the worksurface member such that the interior storage area of the storage member is accessible through the aperture of the worksurface member and such that access to the interior space is uninterrupted between the forwardly facing opening and the upwardly facing opening of the storage member.

2. The worksurface assembly of claim 1, wherein the storage member includes an upwardly extending collar member that extends above the bottom surface of the worksurface member.

3. The worksurface member of claim 1, further including:

a support member secured to the worksurface member and includes a plurality of apertures, and wherein the storage member includes a plurality of lugs that are received within the apertures, thereby supporting the storage member from the support member.

4. The worksurface member of claim 3, wherein the storage member includes an upper flange extending outwardly from at least a select one of the sidewalls and the rear wall, wherein the upper flange abuts the upper surface of the worksurface member.

5. The worksurface member of claim 3, wherein the worksurface member is sandwiched between the upper flange of the worksurface member and the support member.

6. The worksurface member of claim 4, further including:

at least one mechanical fastener that engages at least one of the lugs and the support member to draw the upper flange of the storage member into abutment with the upper surface of the worksurface member.

7. The worksurface member of claim 1, wherein the storage member includes an uppermost edge that is substantially coplanar with the upper surface of the worksurface member.

8. The worksurface member of claim 1, wherein the storage member includes a flange portion readily detachably secured to the bottom surface of the worksurface member.

9. The worksurface member of claim 1, wherein the interior storage area of the storage member has a depth to width ratio that is greater than or equal to about 1:1 at at least one position along a width thereof.

10. The worksurface member of claim 1, wherein the flange portion is integrally formed with the side walls and rear wall of the storage member.

11. The worksurface member of claim 1, wherein the storage member comprises at least one of a metal and a plastic material.

12. A worksurface assembly, comprising:

a worksurface member having an upper surface, a bottom surface, a forward edge and a rearward edge, wherein the worksurface member includes an aperture extending between the upper surface and the bottom surface, and wherein the aperture is located adjacent the forward edge of the worksurface member such that the aperture opens through the upper surface and through the forward edge of the worksurface member; and a storage member including a pair of side walls, a rear wall and a bottom wall that cooperate to form an interior storage area, the storage member includes a forwardly facing opening and an upwardly facing opening such that the interior storage area of the storage member is accessible through the aperture of the worksurface member and such that access to the interior space is uninterrupted between the forwardly facing opening and the upwardly facing opening of the storage member, the storage member including an upper flange extending outwardly from at least a select one of the side walls and the rear wall and abutting the upper surface of the worksurface member, such that the worksurface member is sandwiched between a support member and the upper flange.

13. The worksurface member of claim 12, wherein the support member includes at least one aperture, and wherein the storage member includes at least one lug received within the at least one aperture, thereby supporting the storage member from the support member.

14. The worksurface member of claim 13, wherein at least one mechanical fastener engages the support member and the at least one lug of the storage member to draw the upper flange of the storage member into abutment with the upper surface of the worksurface member.

15. The worksurface member of claim 12, wherein interior storage area has a height to width ratio of greater than or equal to about 1:1 at at least one position along a length thereof.

16. The worksurface member of claim 12, wherein the interior storage area has a depth to width ratio that is greater than or equal to about 1:1 at at least one portion along a width thereof.

17. A method of assembling a worksurface assembly, comprising:

providing a worksurface member having an upper surface, a bottom surface, a forward edge and a rearward edge, wherein the worksurface member includes an aperture extending between the upper surface and the bottom surface, and wherein the aperture is located adjacent the forward edge of the worksurface member such that the aperture opens through the upper surface and through the forward edge of the worksurface member; and providing a support member having a receiving space;

providing a storage member including a pair of side walls, a rear wall and a bottom wall that cooperate to form an interior storage area, wherein the storage member has a forwardly facing opening and an upwardly facing opening, and wherein the storage member includes an upper flange extending outwardly from at least a select one of the pair of sidewalls and the rear wall;

inserting the storage member into the aperture of the worksurface member and the receiving space of the support member, such that the interior storage area of the storage member is accessible through the aperture of the worksurface member, the access to the interior space is uninterrupted between the forwardly facing opening and the upwardly facing opening of the storage member, and the worksurface member is positioned between the support member and the upper flange; and coupling the storage member to the worksurface member and the support member with a fastener member that engages the supporting member and the storage member to draw the upper flange into abutment with the worksurface member.

18. The method of claim 17, wherein the step of inserting the storage member includes inserting at least one supporting tab of the storage member into at least one support aperture of the support member.

19. The method of claim 17, wherein the step of providing the storage member includes providing the interior space of the storage member with a height to width ration of greater than or equal to about 1:1 at at least one position along a length thereof.

20. The method of claim 17, wherein the step of inserting the storage member into the receiving space includes elastically deforming at least a portion of at least one of the side walls towards the interior storage area the storage member.

* * * * *